United States Patent [19]

Meili

[11] Patent Number: 4,667,364

[45] Date of Patent: May 26, 1987

[54] FLOOR-CLEANING MACHINE

[75] Inventor: Hermann Meili, Münchwilen, Switzerland

[73] Assignee: Internationale Octrooi Maatschappij "Octropa" B.V., Rotterdam, Netherlands

[21] Appl. No.: 767,876

[22] Filed: Aug. 21, 1985

[30] Foreign Application Priority Data

Aug. 28, 1984 [GB] United Kingdom ..... 8421711

[51] Int. Cl.[4] ..... A47L 11/30

[52] U.S. Cl. ..... 15/320; 15/319; 15/353

[58] Field of Search ..... 15/50 R, 50 A, 50 C, 15/320, 321, 353

[56] References Cited

U.S. PATENT DOCUMENTS

| | | | |
|---|---|---|---|
| 3,605,786 | 9/1971 | Machin | 15/353 X |
| 4,207,649 | 6/1980 | Bates | 15/321 X |
| 4,210,978 | 7/1980 | Johnson et al. | 15/320 |
| 4,348,783 | 9/1982 | Swanson et al. | 15/320 |
| 4,377,017 | 3/1983 | Herpers et al. | 15/320 |

*Primary Examiner*—Chris K. Moore

*Attorney, Agent, or Firm*—Cushman, Darby & Cushman

[57] ABSTRACT

The invention pertains to floor cleaning machines in which the fresh water and product dosing operation is controlled as a function of the operation of the driving motor such that the dosing per unit of floor area is maintained at an operator-controllable level. Improved economy of water, product and energy is achieved.

10 Claims, 2 Drawing Figures

FLOOR-CLEANING MACHINE

The present invention relates to automatic floor-treating and -cleaning machines.

More particularly, the invention relates to such machines which are used for the cleaning of carpets or hard surfaces of large floor areas, such as in hotels, factories, office buildings, shopping centres and the like.

In general, such machines comprise a motor-driven movable body carrying one or more motor-driven rotatable scrubbers, reservoirs for storing fresh and spent cleaning liquid, a means for dosing fresh cleaning liquid onto the floor and a squeegee/vacuum pick-up system for recovering spent liquid from the floor.

Economy of conventional cleaning machines in respect of consumption of water, detergent and energy has been far from optimal. In general, operator-controlled adjustments to the type of floor or the type of cleaning operation are only possible in a limited way, whereas adjustment during operation to local differences in the floor structure or in respect of the driving speed are not possible at all. Moreover, when the cleaning operation concerns large floor areas, conventional machines can be quite inefficient in that the operator is required to reload fresh cleaning liquid more than once, owing to the often limited storage space for the cleaning liquid. The latter situation has been considerably improved with the introduction of the membrane-divided storage tanks such as disclosed in U.S. Pat. No. 4,210,978.

One object of the present invention is to provide an automatic floor-cleaning machine with improved efficiency of water and detergent consumption.

Another object of the present invention is to provide such machines having improved convenience of operation and providing better adjustment to local cleaning circumstances.

Still another object of the present invention is to provide such a machine having improved operating time- and energy-saving characteristics.

Accordingly, the present invention provides an automatic floor-cleaning machine which comprises a motor-driven movable body carrying one or more motor-driven rotatable brushes, reservoirs for storing fresh and spent cleaning liquid, a means for dosing fresh cleaning liquid onto the floor and a squeegee/vacuum pick-up system for recovering spent liquid from the floor, characterized in that the means for dosing fresh cleaning liquid comprises a dosing pump, the operation of which is controlled as a function of the operation of the body driving motor, such that the dosage of cleaning liquid per unit of floor area is automatically maintained at a set level, which is operator-controllable.

Preferably a floor-cleaning machine according to the present invention further comprises a reservoir for storing detergent product and a pump for dosing said product, the operation of which is controlled as a function of the operation of the body driving motor and/or the motor of the cleaning liquid dosing pump, such that the dosage of detergent product per unit of floor area is automatically maintained at a set level, which is operator-controllable.

In a further aspect of the invention the floor-cleaning machine comprises a vacuum pump in the vacuum pick-up system the motor of which is coupled to a pressure sensor within the pick-up system, the coupling being such that the air-flow through the vacuum pump is automatically maintained at a set level, which is operator-controllable.

Although separate, spatially fixed reservoirs for storing fresh and spent cleaning liquid are quite suitable, it is preferred for reasons of spatial economy that the floor-cleaning machine comprises a tank which is divided into two reservoirs by way of a flexible membrane as described in U.S. Pat. No. 4,210,978, incorporated herein by reference.

The present invention will be further described with reference to the accompanying drawings in which.

Figure 1:
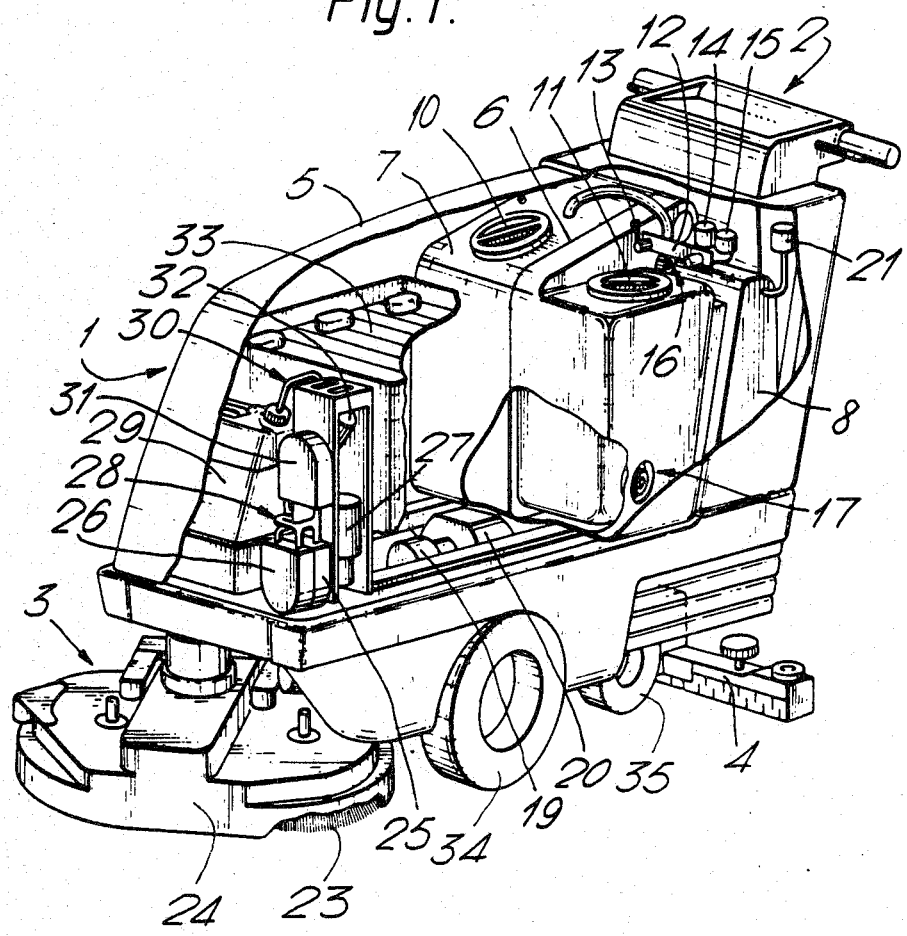
FIG. 1 is a perspective view of an automatic floor-cleaning machine according to the present invention.

Referring now to FIG. 1 an automatic floor cleaning machine is shown, comprising a housing or body (1), means for steering and controlling (2), a brushing means (3) and a squeegee (4). The body (1) has been drawn cut-open for illustration of the interior. It comprises a cover (5) for housing tank, battery, pump and motor parts. A storage tank (6) comprises a first reservoir (7) for storing fresh cleaning liquid and a second reservoir (8) for storing spent cleaning liquid. Although the two reservoirs may have a fixed partitioning wall, it is preferred that they are partitioned by way of a flexible membrane (9). The reservoirs, which are provided with lids (10,11) for maintenance and refilling purposes, can be connected to the water mains for filling and flushing by way of a coupling and valve means (12) comprising a hose connection (13) and valves (14,15) for selection between filling of reservoir (7) or flushing of reservoir (8). Level sensors (16,17,18) are incorporated in the tank walls to indicate maximum and minimum level of fresh cleaning liquid and maximum level of recovered cleaning liquid. The sensors may be float-operated, optical or based upon capacity measurement.

The vacuum pick-up system cooperating with squeegee (4) is operated by way of a vacuum pump (19) driven by motor (20), the pump being connected to the spent liquid reservoir (8) at a point above the maximum liquid level. Vacuum pump (19) may also be reversed acting as a force pump during the draining or flushing operation. For gauging the under- or overpressure above the liquid in tank (6) a pressure gauge (21) is fitted to reservoir (8). The fresh cleaning liquid is pumped from reservoir (7) to the centre of each of the brushes (22,23) under the brush hood (24) by way of pumps (25,26) operated by motor (27). Into line (28) for dispensing the fresh cleaning liquid detergent product is pumped from detergent product reservoir (29) via product line (30) by way of pump (31) operated by motor (32). The vacuum pump motor (19), the liquid pump motors (27,32) and the motor which drives brushes (22,23) are energized by battery (33). The cleaning machine is supported on main drive wheels (34) and one or more caster wheels (35). Driving motor (36) is battery (33) operated enabling ready maneuverability over a wide area. Although the use of a battery is preferred, if so desired the motors may also be energized from an external electrical source through a cord, thereby eliminating battery (33).

Cleaning liquid and detergent product dosing system

Figure 2:
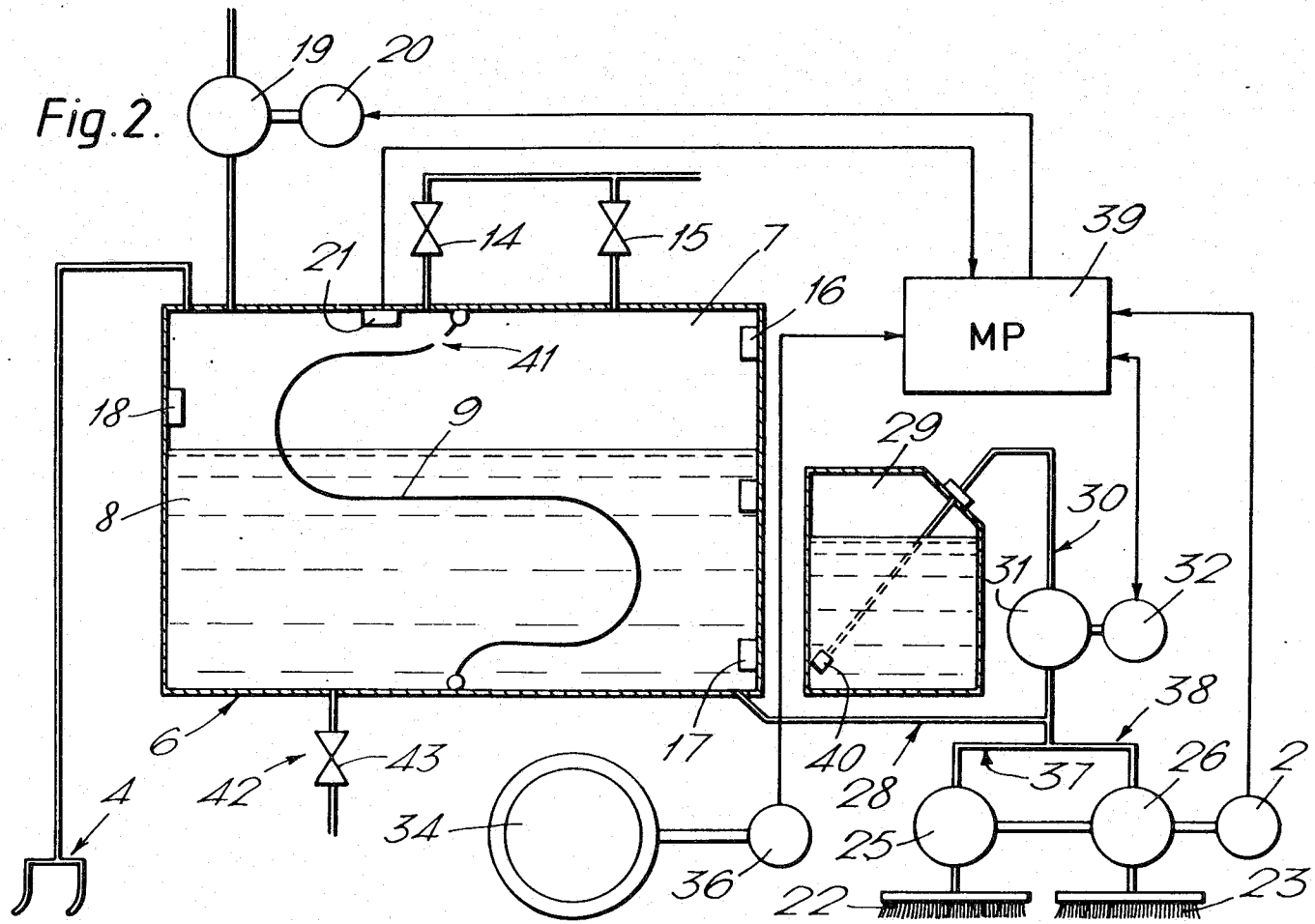
FIG. 2 is a schematic view of the liquid dosing and vacuum pick-up system, part of which is drawn in vertical cross-section.

The cleaning liquid and detergent product dosing system is now more fully described with reference to FIG. 2. Fresh cleaning liquid is pumped from reservoir (7) through cleaning liquid line (28) to brushes (22) and (23) by way of dosing pumps (25) and (26) which are driven by variable speed motor (27).

It is preferred to have a dosing pump in each of liquid lines (37) and (38), but if so desired only a single pump can be incorporated in line (28) before the point where line (28) branches into lines (37) and (38) to each of the brushes.

As an essential feature of the present invention motor (27) is coupled to motor (36) for driving the machine body. To this purpose an electronic controlling device (39) is connected both to dosage pump motor (27) and driving motor (36). The controlling device (39) is set or programmed such that dependent on the driving speed of the body and the cleaning liquid dosage set by the operator it controls in a continuous way the operating speed of motor (27) such that the amount of cleaning liquid pumped and dosed per square meter of area to be cleaned is maintained at the level set by the operator. In this way the amount of fresh cleaning liquid which is applied per square meter of floor area is independent of the driving speed of the machine, i.e. the dosage of cleaning liquor per time unit is adjusted to machine speed, being highest at maximum driving speed and zero if the machine body is stopped or reversed.

It is preferred that the number of pumping cycles by dosing pumps (25) and (26) is monitored by the controlling device (39) to enable calculation on a continuous basis of the consumption of fresh cleaning liquid.

In general a detergent product is added to the fresh cleaning liquid. This may be done in the fresh cleaning liquid reservoir before use, but preferably the mixing-in of the detergent product is effectuated at the moment of application to the floor. From product container (29) the detergent product is fed through product line (30) into cleaning liquid line (28) by way of product dosing pump (31) which is driven by variable speed motor (32). Motor (32) is coupled to the electronic controlling unit (39), which, as indicated hereinbefore, is also coupled to driving motor (36) and pump motor (27) for dosing fresh cleaning liquid.

The controlling device (39) is set or programmed such that, dependent on the instant dosing speed of fresh cleaning liquid and the product concentration level set by the operator, it controls in a continuous way the operating speed of product dosage pump (32) to establish a constant product concentration in the cleaning liquid which is delivered to brushes (22) and (23).

It is preferred that the number of pumping cycles by pump (32) is monitored by the controlling device (39) so that at any moment the consumption of detergent product can be calculated since the previous refilling or replacing of product container (29). Instead of or complementary to the calculation of the consumption or supply of cleaning liquid and detergent product, low and high level sensors (16,17,18,40) are incorporated in tank (6) and product reservoir (29), being coupled to the controlling device (39). In general the low level sensors (17,40) are connected to the electric circuity of pump motors (27) and (32) such that immediate switch-off is established at a low level signal.

The cleaning liquid and detergent product dosing system of the present invention ensures complete control of uniform dosing of cleaning liquid and detergent product and flexibility thereof to the particular circumstances of the scrubbing and cleaning operation. It also provides optimal efficiency and economy given the level and concen-tration conditions set by the operator.

Vacuum pick-up system

During the cleaning operation spent liquid is recovered by way of squeegee (4) which is connected to spent liquid reservoir (8). The sucking operation is effectuated by an under-pressure in liquid reservoirs (7) and (8) and squeegee (4), the under-pressure being generated by vacuum pump (19) driven by variable speed motor (20). For equalizing the pressure in both liquid reservoirs (7) and (8), membrane (9) is perforated (41) near the upper-wall of tank (6).

Motor (20) is coupled to the electronic controlling device (39), which monitors the pressure above the liquid level in tank (6) by means of a pressure gauge (21). Dependent on the pressure sensored by gauge (21) and the air-flow level set by the operator the controlling device calculates and controls the vacuum pump motor (20) such that the air-flow through pump (19) is maintained at the level set by the operator. Accordingly, the suction speed in the pick-up system is uniform and adjustable to the type of floor, while optimal economy and minimum energy consumption are achieved in the process of maintaining the air-flow level set.

In a preferred embodiment the vacuum pump (19) can also be reversed to act as a force pump. In that capacity it is used in the draining operation of the spent liquid reservoir (8). Instead of an under-pressure, an over-pressure is then established which forces the recovered spent liquid out of reservoir (8) through an outlet (42) with a valve (43).

Instead of a valve (43) outlet (42) preferably comprises an outlet hose extending to above the maximum level of recovered liquid, the open end of which is fitted with a non-return ball-valve.

It is preferred that the draining operation is monitored and controlled by controlling device (39) which, by way of the pressure feed back through gauge (21) monitors the over-pressure generated by pump (19) and stops the draining operation when the over-pressure suddenly drops at the moment reservoir (8) has been drained.

In the dosing and pick-up system of the floor cleaning machines according to the present invention the control of the dosing and vacuum pump motors is an essential feature. Many conventional ways for achieving such control will be apparent to those skilled in the art. Although due to current developments in the filed of electronics the coupling between the pump and driving motors are preferably of an electronic nature applying modern chip and microprocessor technology, it will be appreciated that such coupling may also be achieved mechanically without departing from the spirit of the invention.

Preferably the electronic control of the variable speed motors is achieved by way of impulse width modulation, i.e. by way of variating the impulse width at a fixed frequency. Where a wide range of operating speeds is necessary, such as for instance may be the case for the detergent product pump motor, preferably a control is used which combines impulse width modulation for the higher speeds and impulse sequence intermission for the lower speeds.

I claim:

1. A floor-cleaning machine comprising a motor-driven movable body carrying one or more motor-driven rotatable brushes, a reservoir for storing fresh cleaning liquid, reservoir for storing detergent product and a reservoir for storing spent cleaning liquid, dosing means including pump means for applying fresh cleaning liquid and detergent product to the floor to be cleaned, a squeegee/vacuum pick-up system for recovering spent cleaning liquid from the floor and delivering it to said reservoir for storing spent cleaning liquid, means for setting the rate of application of fresh cleaning liquid and detergent product to provide for a predetermined application of said fresh cleaning liquid and detergent product per unit of floor area, and controller means responsive to the movement of said movable body operable to control the rate of application of fresh cleaning liquid and detergent product so as to meet said predetermined rate of application per unit of floor area.

2. A floor-cleaning machine according to claim 1, wherein said pick-up system comprises a vacuum pump, pressure sensor means for monitoring the pressure in said pick-up system, said controller means being operatively associated with said vacuum pump and said sensor means whereby said controller means controls the operation of said vacuum pump as a function of the pressure within the pick-up system, said controller means functioning to maintain air-flow through the vacuum pump at a predetermined operator-controlled level.

3. A floor cleaning machine to claim 2 wherein the vacuum pump is reverse operable as a force pump.

4. A floor-cleaning machine according to claim 3 including means for draining the spent liquid reservoir by reverse operation of the vacuum pump.

5. A floor-cleaning machine according to claim 1, including a partitioning wall comprising a flexible membrane positioned between the reservoirs for storing fresh and spent cleaning liquid so as to separate the same from one another.

6. A floor-cleaning machine according to claim 1, wherein the motor for driving the movable body is capable of reverse operation and the controller means includes means to switch off the pumped dosing means when the machine is standing still or when the driving motor is in reverse operation.

7. A floor-cleaning machine according to claim 1, wherein the controller means includes cycling means for operating the pumped dosing means through a plurality of pumping cycles and means for determining liquid consumption.

8. A floor-cleaning machine according to claim 1, further comprising means for sensing low and high levels for the contents of each of said reservoirs.

9. A floor-cleaning machine according to claim 1, wherein the controller means includes means to control the dosing means by impulse width modulation.

10. A floor-cleaning machine according to claim 9, wherein the controller means includes means providing for impulse width modulation for higher speeds and impulse sequence intermission for lower speeds.

* * * * *